US005907747A

United States Patent [19]

Diener

[11] Patent Number: 5,907,747

[45] Date of Patent: May 25, 1999

[54] PREFILLED, PRESEALED TONER CARTRIDGE INSERT

[75] Inventor: Mark A. Diener, Atlanta, Ga.

[73] Assignee: Ward Sealing, Inc., Woodstock, Ga.

[21] Appl. No.: 09/017,184

[22] Filed: Feb. 2, 1998

[51] Int. Cl.[6] ..... G03G 15/00

[52] U.S. Cl. ..... 399/109; 399/111; 222/DIG. 1

[58] Field of Search ..... 399/106, 107, 399/109, 110, 111, 119, 120, 262, 527; 206/527; 222/DIG. 1

[56] References Cited

U.S. PATENT DOCUMENTS

| | | | |
|---|---|---|---|
| D. 329,453 | 9/1992 | Tashiro | D18/43 |
| 2,248,001 | 7/1941 | Klok | 222/105 |
| 3,731,846 | 5/1973 | Turner et al. | 222/86 |
| 3,837,533 | 9/1974 | Splan | 222/94 |
| 3,999,654 | 12/1976 | Pollack | 206/216 |
| 4,265,372 | 5/1981 | Wainberg | 222/82 |
| 4,650,070 | 3/1987 | Oka et al. | 399/119 |
| 4,692,018 | 9/1987 | Tamura | 399/113 |
| 4,732,277 | 3/1988 | Smith | 399/272 X |
| 4,766,457 | 8/1988 | Barker et al. | 399/106 |
| 4,816,877 | 3/1989 | Keen | 355/133 |
| 4,862,210 | 8/1989 | Woolley | 399/106 |
| 4,895,104 | 1/1990 | Yoshino et al. | 399/106 |
| 4,924,920 | 5/1990 | Bhagwat | 399/258 X |
| 4,989,045 | 1/1991 | Slayton et al. | 399/257 |
| 5,027,156 | 6/1991 | Kobayashi | 399/106 |
| 5,030,998 | 7/1991 | Shibata et al. | 399/106 |
| 5,078,303 | 1/1992 | Kikuchi et al. | 222/167 |
| 5,080,745 | 1/1992 | Paull | 156/247 |
| 5,089,854 | 2/1992 | Kaieda et al. | 399/262 |
| 5,091,750 | 2/1992 | Yoshida et al. | 399/106 |
| 5,101,871 | 4/1992 | Susumu | 399/262 X |
| 5,122,837 | 6/1992 | Sonoda et al. | 399/12 |
| 5,134,960 | 8/1992 | Shirai | 399/105 |
| 5,150,162 | 9/1992 | Saito | 399/224 |
| 5,194,900 | 3/1993 | Hagihara et al. | 399/222 |
| 5,206,619 | 4/1993 | Kita | 399/111 |
| 5,296,902 | 3/1994 | Michlin | 399/109 |
| 5,729,797 | 3/1998 | Okada et al. | 399/120 |

*Primary Examiner*—Sandra Brase
*Assistant Examiner*—Hoan Tran
*Attorney, Agent, or Firm*—Bernstein & Associates, P.C.

[57] ABSTRACT

A toner cartridge insert (10) for use in remanufactured toner cartridges (16) and a method for remanufacturing toner cartridges. The toner cartridge insert (10) is hollow and conforms to the shape of the inside of the toner hopper (40). The toner cartridge insert (10) is presealed and prefilled with toner (13) so that the toner hopper (40) does not have to be cleaned, sealed, and refilled in order to remanufacture a toner cartridge (16).

12 Claims, 3 Drawing Sheets

PREFILLED, PRESEALED TONER CARTRIDGE INSERT

FIELD OF THE INVENTION

The present invention relates to xerographic printing process devices, and more particularly to a toner cartridge insert for use in remanufactured toner cartridges for devices such as laser printers and copiers.

BACKGROUND OF THE INVENTION

Xerographic printing devices such as printers and copiers use standard cartridges for replacement of toner. A standard toner cartridge comprises four main components, including a toner hopper, a magnetic roller assembly, an excess toner catch bin and a photoreceptor drum. The toner hopper and magnetic roller assembly can be separated from the excess toner catch bin and photoreceptor drum. Once the toner hopper and magnetic roller assembly are separated they typically can be broken down further by mechanical means such as by prying them apart with a screwdriver.

With the proliferation of xerographic printing devices such as copiers and laser printers, a significant market has developed for replacement toner cartridges. The most expensive solution for replacement cartridges is to buy a completely new toner cartridge when the old cartridge is spent. A less expensive solution is to purchase a remanufactured toner cartridge. In the remanufacturing process, the toner hopper and magnetic roller assembly are usually separated, cleaned, repaired, refilled with toner, and resealed. A seal is typically placed between the toner hopper and the magnetic roller assembly to prevent toner from flowing out of the toner hopper into the magnetic roller assembly during transport and installation. Remanufacturing is feasible because most of the items (i.e., the toner hopper) are made of hard plastic which do not wear out during normal use and therefore can be reused.

In a typical cartridge remanufacturing operation the cartridge is rebuilt in the following manner. First, the cartridge is split by means of a mechanical device to separate the toner hopper from the magnetic roller assembly. Both parts are cleaned of toner and sealant residue, and the magnetic roller assembly is repaired, if necessary. After the parts are cleaned, a new seal is applied between the toner hopper and the magnetic roller assembly. The seal is typically formed by using a pressure sensitive adhesive or by means of a heat seal. A common pressure sensitive adhesive is made out of strips of specially coated polyester film. A portion of the seal strip is usually arranged so that once the cartridge is reassembled it can be pulled to open the seal and release the toner.

Once the seal is made the toner hopper is filled with toner by opening a fill hole in the cartridge by means of a removable plug. After the plug is removed the toner hopper is filled from a bottle or filling machine, and then any excess toner that may have spilled is cleaned from the hopper.

Once the toner hopper is sealed and refilled with toner it is attached to the magnetic roller assembly by means of clips or other mechanical devices.

During the rebuilding of a toner cartridge there is a significant amount of time spent cleaning, resealing and refilling the toner hopper prior to reattaching it to the magnetic roller assembly. The handling of the toner and the sealing materials introduces the possibility of contamination of the toner, spilling and waste of the toner, or insufficient sealing between the toner hopper and the magnetic roller assembly.

What is needed is a presealed, prefilled toner cartridge insert that fits into the toner hopper and eliminates the need for refilling and resealing the original toner hopper.

SUMMARY OF THE INVENTION

Generally described, the present invention provides a prefilled, presealed toner cartridge insert that is used in remanufactured toner cartridges for xerographic printing devices such as copiers and laser printers.

In a preferred embodiment, the present invention provides a toner cartridge insert for use with a standard toner cartridge. The standard toner cartridge typically has four main components, namely, a toner hopper, a magnetic roller assembly, an excess toner catch bin and a photoreceptor drum. The toner cartridge insert comprises a hollow insert member that is sized to be capable of fitting inside the toner hopper. When a toner cartridge is being remanufactured the toner hopper is usually separated from the magnetic roller assembly, cleaned, refilled with toner and resealed. In the present invention, the toner hopper is cleaned of toner residue and then the insert member is inserted into the toner hopper. The insert member is thin-walled and molded to conform to the inside of the toner hopper so that the volume of the hopper for storing toner is not significantly reduced. The insert member has an opening at one end to allow for flow of the toner from the toner hopper to the magnetic roller assembly. The opening at the end of the insert member is sealed to protect the toner during transport and prior to installation. A sealing member removably attaches to the insert member either by a pressure sensitive adhesive or by means of a heat seal. The seal must be removed at some point prior to using the printing device so that toner can flow from the toner hopper to the magnetic roller assembly.

The invention further comprises a method for remanufacturing a toner cartridge. As described previously, the toner cartridge has a toner hopper and a magnetic roller assembly among other components. The method includes the steps of: separating the toner hopper from the magnetic roller assembly; inserting a prefilled, presealed toner cartridge insert into the toner hopper; and reattaching the toner hopper to the magnetic roller assembly.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
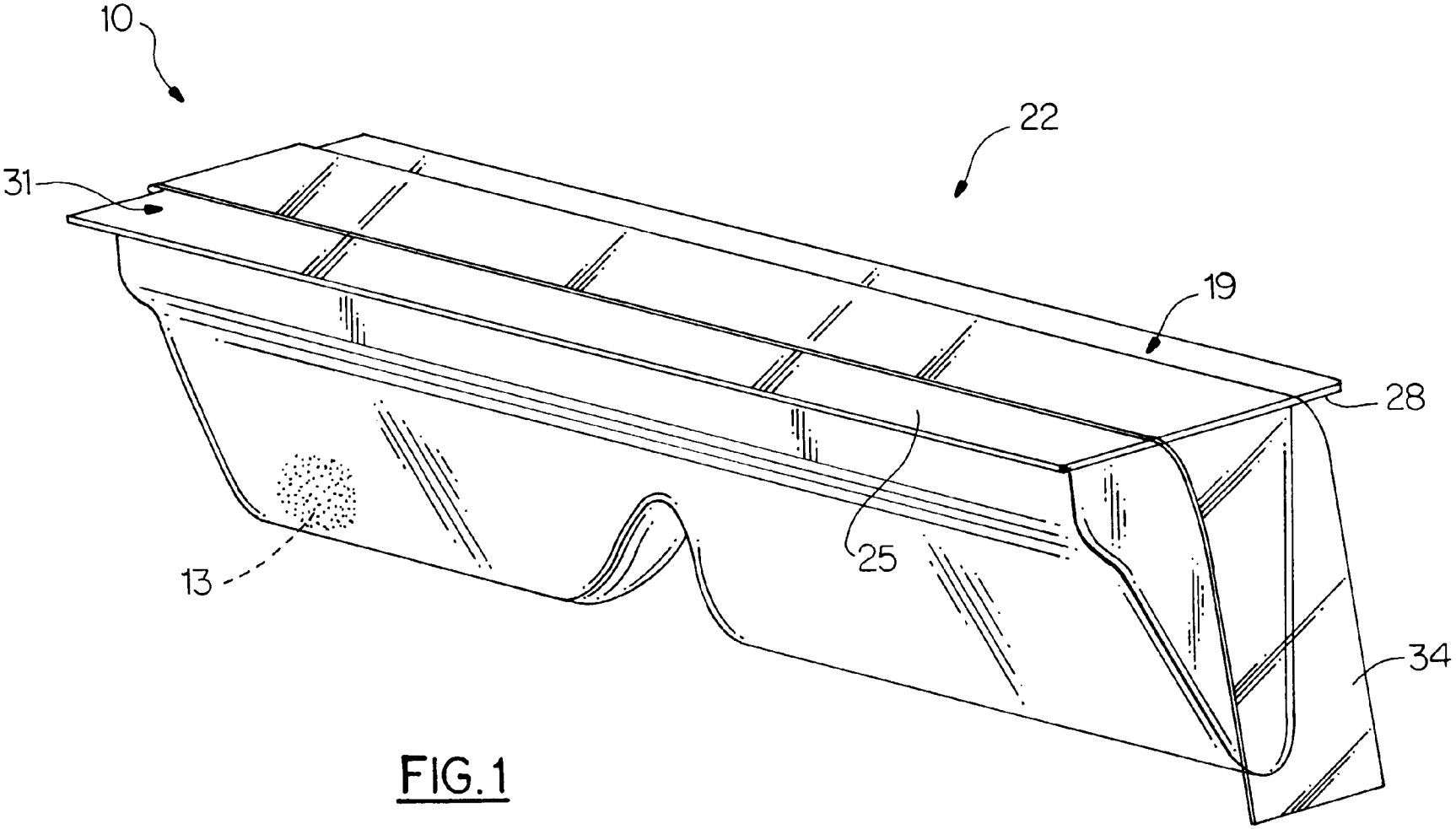
FIG. 1 is a perspective view of the toner cartridge insert of the present invention.

FIG. 1 shows a toner cartridge insert 10 filled with a predetermined quantity of toner 13. Toner is defined as any material that is used for forming a xerographic image. The insert 10 is preferably formed out a thin-walled plastic that is semi-rigid and may be formed out of polystyrene or other suitable materials. While a semi-rigid thin-walled plastic is preferred, other materials such as a flexible material formed out of polyethylene or polyurethane could be used with some type of a support structure to form the insert 10. The plastic material for the insert 10 is thick enough to have sufficient structural integrity to support the weight of the toner 13 that it holds. However, the insert 10 has to be relatively thin in order to prevent the insert 10 from taking up too much space and reducing toner volume to any appreciable degree. The profile of the insert 10 varies depending on the particular toner cartridge 16 (shown in FIG. 3) that the insert 10 is used with. The insert 10 is formed out of a unitary solid piece of plastic with an opening 19 on one side 22. The opening 19 is sealed by a removable seal 25 that forms a barrier to prevent movement of the toner 13 from the insert 10. The opening 19 is preferably bordered by a lip 28. The lip 28 is formed by a flat surface 31 that extends horizontally around the entire perimeter of the opening 19. The lip 28 provides a suitable surface for attaching the removable seal 25. A tear away strip 34 provides for breaking the seal 25 to allow the toner 13 to flow out of the insert 10.

Figure 2:
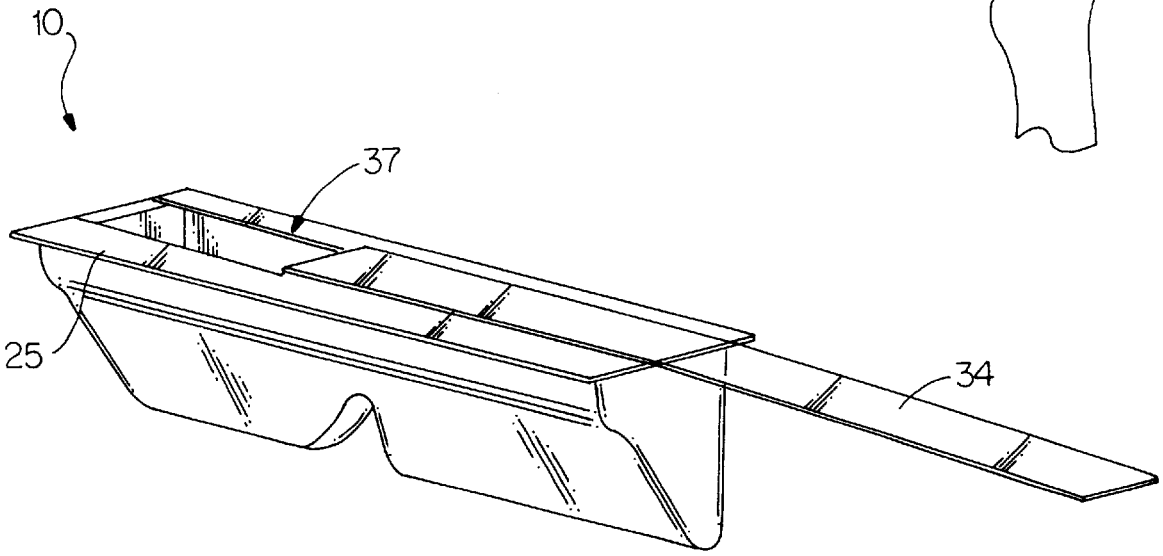
FIG. 2 is a perspective view of the toner cartridge insert of the present invention with the removable seal partially removed.

In FIG. 2, the strip 34 is shown partially removed from the seal 25. The strip 34 may undo a portion of the seal 25 that is bordered by a frangible portion 37 or the strip 34 may undo the entire seal 25.

Figure 3:
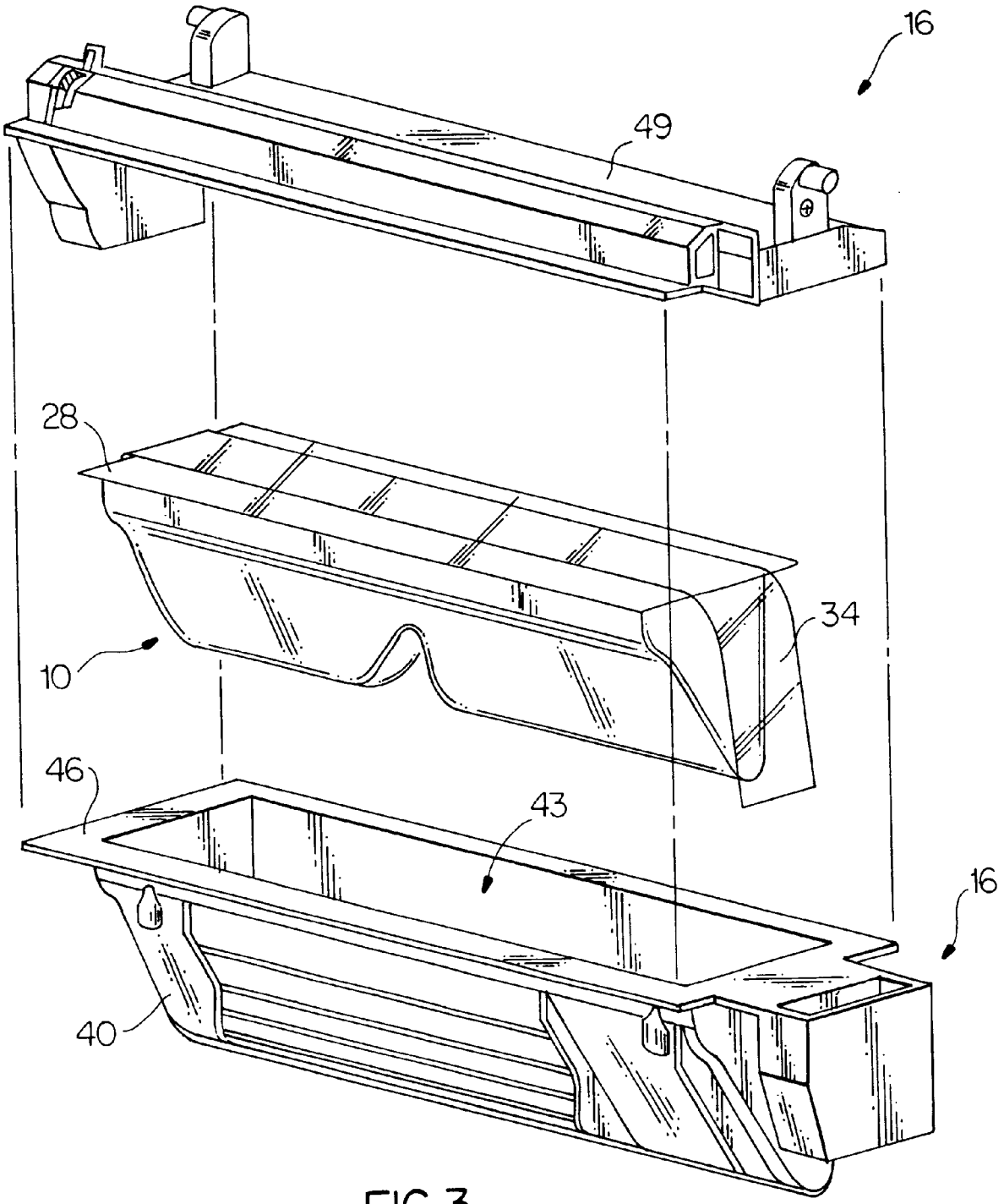
FIG. 3 is an exploded perspective view of a standard toner cartridge with the toner cartridge insert of the present invention positioned for insertion into the cartridge.

Turning to FIG. 3, the insert 10 fits into the toner cartridge 16 by conforming to the shape of the inside of the toner hopper 40. Depending on the make and model of the printer (not shown) or other device, the dimensions of the toner hopper may vary. The present invention may be adapted to different shapes and sizes of toner hoppers and is not intended to be limited to any particular size or shape. The opening 43 in the toner hopper 40 has a lip 46 around its edge that corresponds to the lip 28 on the insert 10. The magnetic roller assembly 49 fits over the top of the insert 10 when it attaches to the toner hopper 40.

The insert 10 of the present invention is used in the remanufacturing of toner cartridges 16 in the following manner. The toner hopper 40 is separated from the magnetic roller assembly 49 by means of a mechanical device (not shown). Both parts are cleaned of toner 13 and sealant residue, and the magnetic roller assembly 49 is repaired, if necessary.

Figure 4:
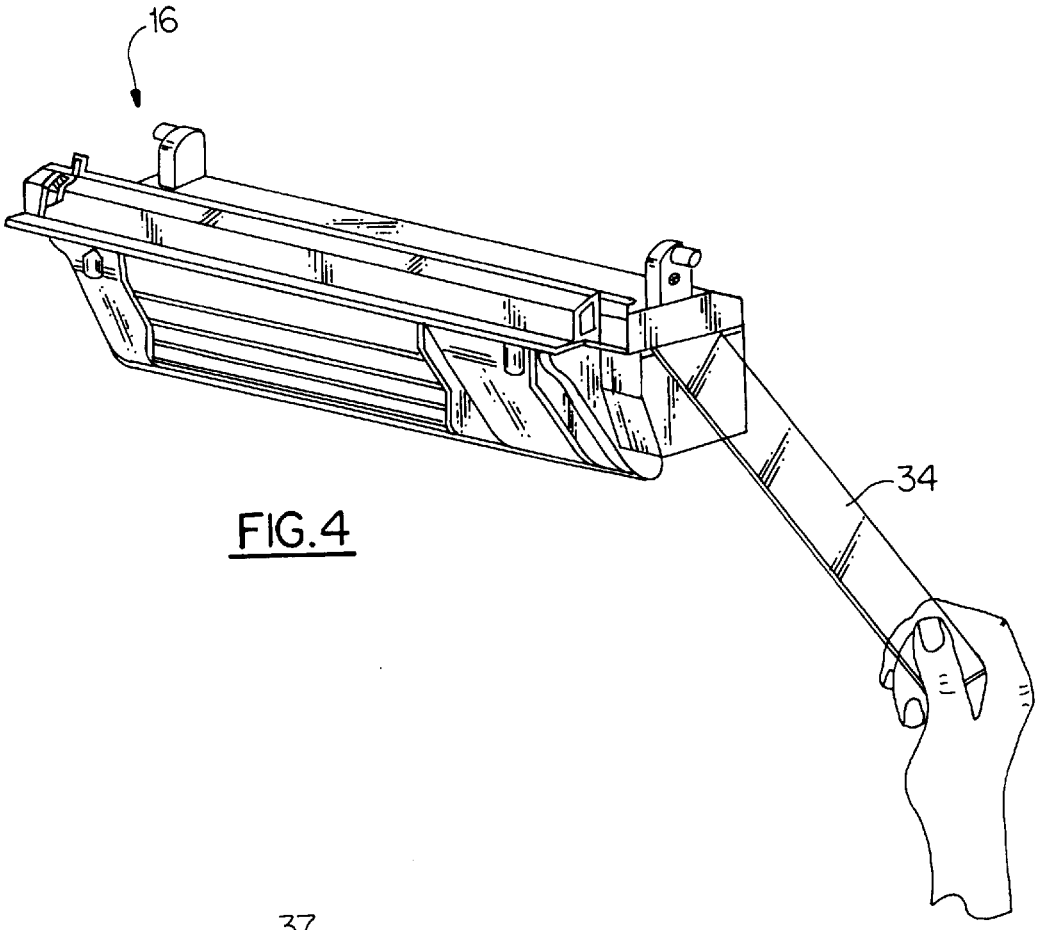
FIG. 4 is a perspective view of a toner cartridge with the toner cartridge insert of the present invention.

Once the toner hopper 40 is cleaned of residue from the toner 13, the insert 10 is inserted into the toner hopper 40 and the two parts of the toner cartridge 16 are reassembled. The insert 10 is prefilled with a predetermined quantity of toner 13, and the opening 19 at the end of the insert 10 is presealed to protect the toner 13 during transport and handling prior to installation. The removable seal 25 preferably attaches to the insert 10 by a pressure sensitive adhesive. However, a heat seal or other sealing method including methods that involve a third party agent and those that do not, such as, but not limited to, sonic welding, fusing, solvent addition, or the like are contemplated as known substitutes for adhesive. The seal 25 must be removed at some point prior to using the printing device so that toner 13 can flow from the toner hopper 40 to the magnetic roller assembly 49. As shown in FIG. 4, the seal 25 is preferably removed from the assembled cartridge 16 by the strip 34 that can be pulled out from the side of the cartridge 16 after installing the cartridge 16 in the printer (not shown). The preferred materials are Nitto (Japan) tape and adhesive coated Teslin (PPG) as coated by Mactac.

The invention also includes a method for remanufacturing a toner cartridge 16. As described previously, the toner cartridge 16 includes a toner hopper 40 and a magnetic roller assembly 49. The method includes the steps of: (a) separating the toner hopper 40 from the magnetic roller assembly 49; (b) inserting a prefilled, presealed toner cartridge insert 10 into the toner hopper 40; and, (c) reattaching the toner hopper 40 to the magnetic roller assembly 49 by means of a clip or other method. Accordingly, the present invention offers several advantages, including reducing the amount of time spent cleaning, resealing and refilling the toner hopper 40 prior to reattaching it to the magnetic roller assembly 49.

Another advantage is that the handling of the toner 13 and the sealing materials, which creates the possibility of contamination of the toner 13, spilling and waste of the toner 13, or insufficient sealing between the toner hopper 40 and the magnetic roller assembly 49, is eliminated.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A toner cartridge insert for use with a standard toner cartridge, the toner cartridge having a toner hopper and a magnetic roller assembly, the toner cartridge insert, comprising:

a) a hollow insert member having a shape generally conforming to the toner cartridge shape and an exterior surface defining a size slightly less than the size defined by the interior surface of the toner cartridge, the hollow insert member enclosed within the toner cartridge, the hollow insert member having an open side defined by an edge, the edge having a generally flat lip extending therefrom and bordering the opening on all sides, the generally flat lip extending only outward from the edge of the opening so that toner will not accumulate on the edge or lip; and b) a sealing member removably attached to the lip of the insert member adjacent all edges of the opening.

2. The toner cartridge insert of claim 1, wherein a predetermined quantity of toner is disposed inside the insert member.

3. The toner cartridge insert of claim 1, wherein the insert member is rigid.

4. The toner cartridge insert of claim 1, wherein the insert member is elongated and has a generally wedge-shaped cross-sectional profile.

5. The toner cartridge insert of claim 4, wherein the generally wedge-shaped insert member has a notch defined in the length of the insert member at a vertex of the wedge-shaped insert member.

6. The toner cartridge insert of claim 1, wherein the lip of the insert member engages and is supported by a lip of the toner cartridge.

7. The toner cartridge insert of claim 1, wherein the opening in the insert member is generally rectangular.

8. The toner cartridge of claim 7, wherein the sealing member has a generally rectangular shape generally conforming to the shape of the opening in the insert member, the scaling member having a larger area than the opening.

9. The toner cartridge of claim 1, wherein the sealing member attaches to the lip of the toner cartridge insert by an adhesive.

10. The toner cartridge insert of claim 1, wherein the sealing member comprises a flexible strip.

11. The toner cartridge insert of claim 1, wherein the flexible strip includes a strip portion extending from the insert member and extending through a feed slot in the toner hopper.

12. A method for remanufacturing a toner cartridge, the toner cartridge comprising a toner hopper and a magnetic roller assembly, the method comprising:

a) separating the toner hopper from the magnetic roller assembly;

b) inserting a prefilled, presealed toner cartridge insert having a shape generally conforming to the toner cartridge shape and an exterior surface defining a size slightly less than the size defined by the interior surface of the toner cartridge, the hollow insert member enclosed within the toner cartridge, the hollow insert member having an open side defined by an edge, the edge having a generally flat lip extending therefrom and bordering the opening on all sides, the generally flat lip extending only outward from the edge of the opening so that toner will not accumulate on the edge or lip, and a sealing member removably attached to the lip of the insert member adjacent all edges of the opening into the toner hopper, and, c) reattaching the toner hopper to the magnetic roller assembly.

* * * * *